United States Patent [19]

Salacuse

[11] Patent Number: 4,722,627

[45] Date of Patent: Feb. 2, 1988

[54] CLIP-ON PAPER HOLDING SYSTEM

[75] Inventor: Frank Salacuse, New York, N.Y.

[73] Assignee: Super Glue Corporation, Hollis, N.Y.

[21] Appl. No.: 889,444

[22] Filed: Jul. 23, 1986

Related U.S. Application Data

[63] Continuation of Ser. No. 773,955, Sep. 9, 1985, abandoned, which is a continuation of Ser. No. 567,831, Jan. 3, 1984, abandoned.

[51] Int. Cl.[4] ..... B42F 3/02; B42F 13/20; B42F 13/00

[52] U.S. Cl. ..... 402/20; 402/36; 402/75

[58] Field of Search ..... 402/20, 31, 37, 36, 402/75, 19, 43, 80 P

[56] References Cited

U.S. PATENT DOCUMENTS

| | | | |
|---|---|---|---|
| 841,706 | 1/1907 | Morden | 402/20 |
| 861,050 | 7/1907 | Perkins | 402/20 |
| 2,063,548 | 12/1936 | Greer | 402/20 |
| 2,223,030 | 11/1940 | Edler et al. | 402/20 |
| 3,105,494 | 10/1963 | Duncan | 402/36 |
| 3,950,107 | 4/1976 | Seaborn | 402/75 X |
| 3,995,961 | 12/1976 | Dorfman et al. | 402/20 X |

FOREIGN PATENT DOCUMENTS

| | | | |
|---|---|---|---|
| 219478 | 7/1924 | United Kingdom | 402/75 |

*Primary Examiner*—E. R. Kazenske
*Assistant Examiner*—Paul M. Heyrana, Sr.
*Attorney, Agent, or Firm*—Paul J. Sutton

[57] ABSTRACT

The present invention provides a clip-on paper holding system for a snap-clamp device made in one piece of plastic. The system uses the snap-clamp device as a paper holder for receiving and holding sheets of punched hole paper. The device is used either with a note pad base to hole punched paper, or with a notebook where the snap-clamp device is mounted to an elongated mounting member that is affixed to the inner surface of the spine of a notebook. One, two, or more devices are used depending on how many holes are formed in the note paper.

5 Claims, 7 Drawing Figures

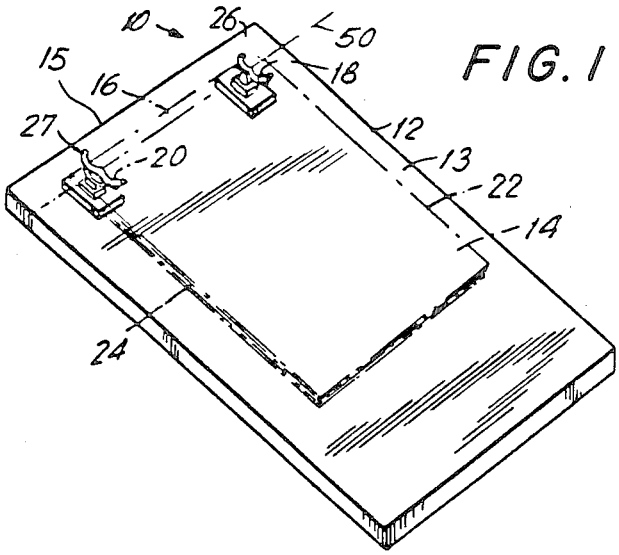
FIG. 1
FIG. 2
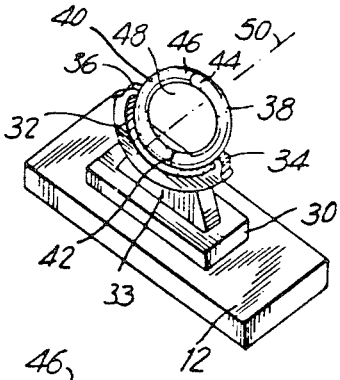
FIG. 4
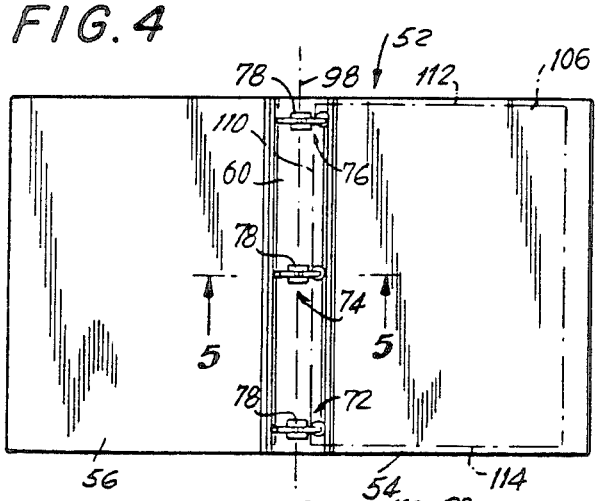
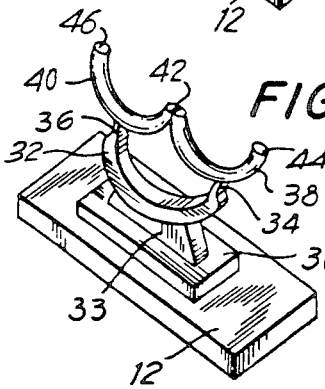
FIG. 3
FIG. 5
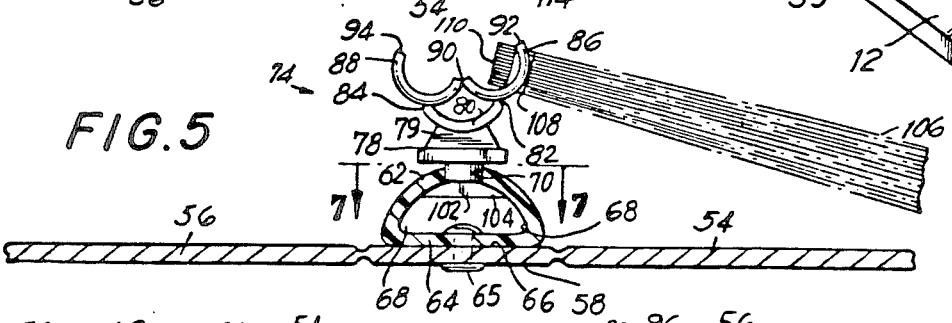
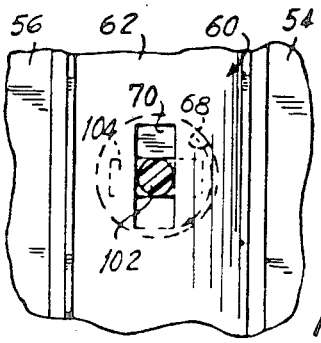
FIG. 7
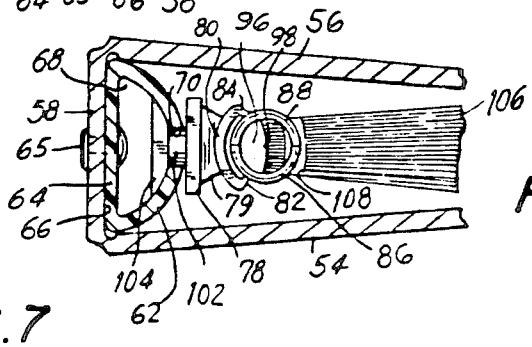
FIG. 6

CLIP-ON PAPER HOLDING SYSTEM

CROSS-REFERENCE TO RELATED APPLICATIONS

This application is a continuation of patent application Ser. No. 773,955, filed Sept. 9, 1985, now abandoned, which was a continuation of Ser. No. 567,831, filed Jan. 3, 1984, now abandoned.

This invention relates generally to clip-on holding systems and more particularly to a clip-on paper holding system for a multipurpose, snap-clamp device capable of releasably holding objects.

U.S. Pat. No. 4,240,604 describes a clamping device having a snap-clamp part which is capable of releasably holding varied objects used in a household or a workshop. The device has a clamp which snaps open to an open position and snaps shut to a closed position. As described in U.S. Pat. No. 4,240,604, the device is permanently mounted with the clamps of the device in a horizontal alignment with the gripping space formed by the clamps.

It is an object of the present invention to provide a clip-on paper holding system that widens the applicability of the snap-clamp device described in U.S. Pat. No. 4,240,604.

It is another object of the present invention to provide a snap-clamp paper holding system that is used with note paper with holes and that can be affixed to a note pad base.

It is another object of the present invention to provide a snap-clamp paper holding system that can be used to hold punched hole paper in a notebook.

It is a further object of the present invention to provide a mounting post with a cross-bar for a snap-clamp device so that the cross-bar can be inserted into an elongated mounting base affixed to the inner spine of a notebook.

It is yet another object of the present invention to adapt control levers of the snap-clamp device of U.S. Pat. No. 4,240,604 to receive the holes of punched note paper for mounting on a note pad base or to the inner spine of a notebook.

In accordance with these and other objects, there is provided a clip-on paper holding system that comprises a base member, at least one sheet of paper having an edge portion, the sheet forming at least one hole proximate to the edge portion of the sheet, and a snap-clamp means connected to the base member. The snap-clamp means is basically the snap-clamp device of U.S. Pat. No. 4,240,604 adapted for use as a punched paper holder. In the open position, either control lever can receive the hole of the punched sheet of paper. In the closed position, the control levers together form an annular gripping space that holds the sheet in position.

The present invention will be more clearly understood from the following description of specific embodiments of the invention together with the accompanying drawings where similar reference characters denote similar elements throughout the several views and in which:

FIG. 1 is a perspective view of one embodiment of the present invention illustrating the clip-on paper holding system used as a note paper clip;

FIG. 2 shows an isolated perspective view of a single snap-clamp paper holding device as shown in FIG. 1 in a closed position;

FIG. 3 shows an isolated perspective view similar to FIG. 2 showing the snap-clamp device in an open position;

FIG. 4 is a top view of another embodiment of the present invention illustrating the clip-on paper holding system used as a clip-holder for a notebook;

FIG. 5 is a cross-section taken through line 5—5 of FIG. 4;

FIG. 6 is a cross-section showing the snap-clamp device in a closed position in a notebook; and FIG. 7 is an isolated cross-section taken through line 7—7 of FIG. 5.

Reference is now made in more detail to the drawings.

One embodiment of clip-on paper holding system 10 is illustrated in a perspective view in FIG. 1. System 10 as shown in FIG. 1 includes a rectangular note pad base 12 and a multiplicity of rectangular sheets 14 of note paper positioned lying on the upper flat surface 13 of base 12, which is slightly larger in its rectangular configuration than support sheets 14. Each sheet of paper 14 has a straight top edge 16. Each sheet 14 forms a pair of circular holes 18 and 20 spaced apart from one another and spaced approximately equally from straight top edge 16. In addition, each hole 18 and 20 is spaced approximately equally from opposed straight side edges 22 and 24 of rectangular sheets 14. Holes 18 and 20 are formed proximate to top edge 16.

A pair of snap-clamp devices 26 and 27 are affixed to upper surface 13 of base 12 at convenient distances from the top end 15 of base 12 and spaced apart so as to receive holes 18 and 20 of sheets 14. Snap-clamp devices 26 and 27 are similar in construction, arrangement, and operation to the snap-clamp devices described in U.S. Pat. No. 4,240,604 with certain changes that adapt them for paper holding as will now be described.

Snap-clamp devices 26 and 27 are identical, and only one typical snap-clamp device will be described herein, namely snap-clamp device 26 as shown in more detail in FIGS. 2 and 3, which are enlarged views of snap-clamp device 26 in a closed and an open position, respectively.

As shown in FIGS. 2 and 3 snap-clamp device 26 is preferably injection molded in one piece from polypropylene. Snap-clamp device 26 includes a support member 30 having a flat bottom connected to surface 13 of note pad base 12 by adhesion or other known method. An arcuate bending spring 32 that is approximately semicircular in lateral cross-section is secured in one piece to the top of support member 30 via connecting portion 33 at the lower, or outer surface of spring 32. Bending spring 32 has two end portions having first and second film-hinges 34 and 36. Two arcuate interconnected first and second control levers 38 and 40 are respectively rotatably connected to first and second film-hinges 34 and 36 at their mid-portions of the lower, or outer, surfaces. First and second film-hinges 34 and 36 are rotatably interconnected by interconnecting film-hinge 42. First and second control levers 38 and 40 are approximately circular in transverse cross-section having control-lever diameters less that the diameter of equal-sized circular holes 20. First and second control-levers 38 and 40 have first and second tip portions 44 and 46, respectively, which are rounded, or hemispherical, which are best seen in FIG. 3. Control levers 38 and 40 are capable of being moved between a closed position as shown in FIG. 2 and an open position as seen in FIG. 3. In the closed position, tip portions 44 and 46 are held together by bending spring 32 in its unbiased mode wherein first and second control levers 38 and 40 form an annular gripping space 48 and interconnecting film hinge 42 is positioned proximate to bending spring 32, and interconnecting film-hinge 42 and first and second film hinges 34 and 36 form an angle greater than 180 degrees relative to support member 30 and base 12. In the open position, tip portions 44 and 46 are held apart by bending spring 32 in its unbiased mode wherein interconnecting film-hinge 42 is spaced away from bending spring 32, and interconnecting film-hinge 42 and first and second film hinges 34 and 36 form an angle less than 180 degrees relative to support member 30 and base 12. When control levers 38 and 40 are in their closed position and then forced apart into their open position, bending spring 32 is spaced apart, or bent, into its biased mode as the control levers pass into a 180 degree angle with interconnecting film hinge 42 and mode then returns to its biased mode when control levers 38 and 40 pass into their open mode. Likewise, bending spring 32 bends into its biased mode when control levers 38 and 40 are moved from an open mode into a closed mode, when bending spring 32 unbends to its unbiased mode. When first and second control levers 38 and 40 are in either the closed or open modes, bending spring 32 locks control levers 38 and 40 into their closed or open positions, because any opposite movement against spring 32 by motion of control levers 38 and 40 is resisted as spring 32 is pressed into its biased mode.

When control levers 38 and 40 are in the closed position, gripping space 48 as stated is approximately annular and has an axis 50 capable of being received by holes 18 and 20 when devices 26 and 27 are in the open position. When in their closed positions, both control levers 26 and 27 act to hold sheets 14 by way of being inserted through holes 18 and 20.

Attention is now directed to FIG. 1 where snap-clamp device 26, which has been described in detail, and snap-clamp device 27, which is a duplicate of device 26, are mounted with their gripping spaces 48 in alignment, that is, both axes 50 are in alignment. Control levers 38 and 40 of snap-clamp devices 26 and 27 are aligned with holes 18 and 20. As shown in FIGS. 2 and 3, control lever 38 is positioned toward top end 15 of base 12 and control lever 40 is positioned away from top end 15. Control levers 40 of devices 26 and 27 in particular are aligned so that they are capable of receiving and holding sheets 14 by way of tip portions 46 and 47.

Another embodiment of the present invention is shown in FIGS. 4, 5, 6, and 7 where a notebook 52 is shown using a variation of snap-clamp system 10. Notebook 52 has opposed covers 54 and 56 and a spine 58 that flexibly connects covers 54 and 56. An elongated mounting member 60 of rigid material having a top wall 62 and an opposed bottom wall 64 is connected to inner surface 66 of spine 58 at bottom wall 64 by pins 65. Elongated member 60 forms three hollows 68, a typical one being shown in FIGS. 5 and 6. Three slots 70 each generally lateral to the elongated direction of member 60 are formed in top surface 62 and lead to hollows 68. Three duplicate snap clamp devices 72, 74, and 76 are mounted at equal intervals to elongated member 60 in a manner to be described. Center snap clamp device 74 will be described as typical of devices 72 and 76.

Snap-clamp device 74 has the same features as snap-clamp device 26 described above, namely a support member 78 with connecting portion 79, a bending spring 80, first and second film-hinges 82 and 84, first and second control levers 86 and 88, interconnecting film-hinge 90, first and second tip portions 92 and 94, and annular gripping space 96 with axis 98. These aforenamed elements are directly analagous with support member 30 and connecting portion 33, bending spring 32, first and second film hinges 34 and 36, first and second film levers 38 and 40, interconnecting film-hinge 42, first and second tip portions 44 and 46, and annular gripping space 48 with axis 50 of snap-clamp device 26.

Support member 78 is connected in one piece to connecting portion 75 and is generally rectangular in configuration, as seen in FIG. 4, but can have other configurations such as circular. Support member 78 is larger than slots 70. A post 102 extends, preferably in one piece, from the bottom of support member 78. The other, or bottom, end of post 102 is connected to a cross-bar 104 that has a pair of opposing arms that extend approximately in the same plane as first and second control levers 86 and 88, that is, transversely across the longitudinal direction of elongated member 60. As seen in FIG. 7, slots 70 are formed at the center of elongated member 60 and extend laterally to, or in the same direction, as the longitudinal direction of member 60. Post 102 and cross-bar 104 are adapted to be received by slot 70 and to be passed into hollow 68. Snap-clamp device 74 is adapted to be rotated so as to rotate post 102 and cross-bar 104 in hollow 68. Top wall 62 of elongated member 60 is arcuate in transverse cross-section as seen in FIGS. 5 and 6 and the upper portions of the arms of cross-bar 104 are also arcuate, so that when cross-bar 104 is rotated in hollow 68, the arms of cross-bar 104 are pressed against the under surface of top wall 62, which position wedges post 102 in slot 70 between base 100 positioned over top wall 62 and cross-bar 104 positioned under wall 62.

A multiplicity of rectangular sheets 106 of notebook paper form three equally spaced holes 108 formed in the paper each spaced equidistantly and proximate to inner straight edge 110 of sheets 106 with the outer two holes spaced equidistantly from opposed side edges 112 and 114. Covers 54 and 56 are adapted to cover sheets 106 when the notebook is closed as shown in FIG. 6.

As indicated in FIGS. 4 and 5, sheets 106 are mounted onto first control lever 86, and as seen in FIG. 5, of first control lever 86 of center snap-clamp device 74, via the holes 108 which are adapted to receive either control lever 86 or 88. The open position of control levers 86 and 88 are illustrated in FIGS. 4 and 5. The closed position of control levers 86 and 88 are shown in FIG. 6, where sheets 106 are held by both first and second control levers 86 and 88.

The operation of control levers 86 and 88 is identical to the operation of first and second control levers 38 and 40 described earlier with reference to the first embodiment and snap-clamp devices 26 and 27.

The embodiment of the invention particularly disclosed and described hereinabove is presented merely as an example of the invention. Other embodiments, forms, and modifications of the invention coming within the proper scope and spirit of the appended claims will, of course, readily suggest themselves to those skilled in the art.

What is claimed is:

1. A clip-on paper holding system for paper sheets, each sheet, having an edge portion, said sheet forming at least one hole proximate to said edge portion of said sheet, said system comprising:

a base member for mounting to an article, and a snap-clamp means made of one piece of plastic connected to said base member, said snap-clamp means comprising:

a bending spring, arcuate in shape and connected to said base, a pair of control levers, arcuate in shape, and rotatably connected to said bending spring by first and second living hinges connected from the end portions of the arc of the bending spring directly to the mid-portions of the outer surfaces of the control levers, each control lever's upper portion diameter being less than that of said sheet hole, so that said sheet may be retained on one of the control levers by said hole, said control levers being rotatably joined to one another by one end of each, by a molded hinge, and being capable of being moved to an open position and a closed position, wherein in said closed position said control levers are held together by said bending spring to form an annular closed gripping space by said bending spring, and in said open position said control levers are held apart by said bending spring, said hole being adapted to receive either of said control levers, whereby in said closed position said sheet is held by said arcuate control levers, and in said open position said sheet can be removed from or placed into said arcuate control levers.

2. A clip-on paper holding system according to claim 1, wherein said snap-clamp means includes two pairs of control levers, each mounted to a surface by its base member, and each having an axis of said annular closed gripping space in said closed position, said axes being approximately aligned and said pairs of control levers being approximately parallel, said two pairs of control levers being capable or receiving and holding a multiplicity of sheets by their holes.

3. A clip-on paper holding system according to claim 2, wherein said base member is a note pad base and said snap-clamp means includes a support member connected to the outer surface of each said arcuate bending spring, each said support member being affixed to said note pad base.

4. A clip-on paper holding system according to claim 2, further comprising:

a notebook having two opposed covers, and a spine portion flexibly connecting said two covers, said base member being an elongated member having a top wall and an opposed bottom wall affixed to the inner surface of said spine portion, said elongated member forming at least one hollow, and a pair of slots at said top wall leading to said hollow, said snap-clamp means further including a support member, a post connected to said support member at one end, and a cross-bar connected to the other end of said post, the outer surface of said arcuate bending spring being connected to said support member, said cross-bar being adapted to be received by one of said slots and passed to said hollow, said cross-bar being adapted to be rotated in said hollow, the inner walls of said hollow being adapted to receive said cross-bar in a wedging relationship, said cross-bar and said snap-clamp means being releasably locked in said hollow upon rotation of said snap clamp means with said cross-bar in said hollow, said axis of said annular closed gripping space of said pair of control levers in said closed position being aligned lateral to the longitudinal direction of said elongated member when said snap-clamp means is in said locked position.

5. A clip-on paper holding system according to claim 4, wherein each said sheet further forms a plurality of holes approximately equally spaced from one another and from each said straight edge; and said snap-clamp means includes a plurality of pairs of control levers having axes approximately aligned and approximately parallel to said straight edge; said elongated member forming a plurality of hollows and slots opening to said plurality of hollows, said slots being aligned with said plurality of control levers, said snap-clamp means having a plurality of cross-bars each adapted to be received by each of said slots and passed to each of said hollows and rotated to said releasably locked position.

* * * * *